US006570959B1

(12) United States Patent
Kuzniar

(10) Patent No.: US 6,570,959 B1
(45) Date of Patent: May 27, 2003

(54) X-RAY TUBE METAL FRAME GETTERING DEVICE

(75) Inventor: Daniel E. Kuzniar, Lyons, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 15 days.

(21) Appl. No.: 09/908,338

(22) Filed: Jul. 18, 2001

(51) Int. Cl.[7] ..... H01J 35/20

(52) U.S. Cl. ..... 378/123; 378/121; 313/554; 313/558; 313/566

(58) Field of Search ..... 378/119, 121, 378/123; 313/553, 554, 558, 560, 561, 562, 566; 219/121.27

(56) References Cited

U.S. PATENT DOCUMENTS

| | | | | |
|---|---|---|---|---|
| 3,639,849 A | * | 2/1972 | Bennett | 313/420 |
| 3,663,855 A | * | 5/1972 | Boettcher | 313/566 |
| 5,509,045 A | | 4/1996 | Kautz | 378/123 |
| 5,838,761 A | | 11/1998 | Behner et al. | 378/123 |
| 6,192,106 B1 | | 2/2001 | Miller et al. | 378/123 |
| 6,351,520 B1 | * | 2/2002 | Inazaru | 378/138 |

FOREIGN PATENT DOCUMENTS

JP 2001-155671 * 6/2001

* cited by examiner

*Primary Examiner*—Drew A. Dunn
(74) *Attorney, Agent, or Firm*—Fay, Sharpe, Fagan, Minnich & McKee, LLP

(57) ABSTRACT

A metal frame x-ray tube (1), includes a gettering system (90) which, when activated, provides a layer (147) of gettering material (98) on a grounded conductive portion (72, 74) of a metal frame or envelope (14). The envelope defines an evacuated chamber (12), which houses an anode (10) and a cathode (18). Moving the gettering material to larger diameter portions of the frame enables substantially larger amounts of gettering material to be provided than in a conventional gettering system, which is typically housed in the cathode assembly (26). Moreover, multiple independently controllable gettering wires (92, 94) facilitate reactivating the gettering material plural times both during the manufacturing process and in the field. This ability to rejuvenate vacuum pumping capability in an x-ray tube that is starting to arc in the field allows for extended x-ray tube life.

20 Claims, 5 Drawing Sheets

X-RAY TUBE METAL FRAME GETTERING DEVICE

BACKGROUND OF THE INVENTION

The present invention pertains to the vacuum tube arts, and in particular to a getter for maintaining vacuums. It finds particular application in conjunction with rotating anode x-ray tubes for CT scanners and will be described with particular reference thereto. However, it is to be appreciated that the present invention will also find application in the generation of radiation and vacuum tubes for other applications.

Typically, rotating anode x-ray tubes include a sealed and evacuated envelope in which the cathode, anode, anode bearings, anode rotor, and other associated structures are sealed. To maintain the vacuum in x-ray tubes, getters are traditionally mounted inside the vacuum envelope to absorb stray gases. During manufacture, the tube components are cleaned and baked in vacuum furnaces. This procedure reduces the amount of surface contaminants available to evolve gases when the tubes are in service. The cleaned x-ray tube components are then assembled and placed within the envelope. The envelope is evacuated using a vacuum pump while it undergoes various heating processes that liberate absorbed gases from the surfaces of the internal parts. The envelope is then sealed to maintain the vacuum integrity.

The getter material is generally activated after the vacuum pump has exhausted the tube and the tube is permanently sealed off. Depending on the type of material, getters are classified as either evaporable or non-evaporable, e.g., a bulk getter. Activating the getter material may include flashing the getter for an evaporable material or actuating the getter by raising its temperature for a bulk or non-evaporable getter.

One method of activating (flashing) an evaporable getter is accomplished by locating a source of an electromagnetic field, usually an RF field, outside the evacuated envelope, proximate the getter wire/coil located inside the envelope. An electromagnetic field is generated and couples with the getter wire/coil, thereby inducing current flow in the wire/coil and heating the getter material in contact with the coil. The heated getter material evaporates and atoms, e.g. barium atoms, leave the getter wire/coil and are deposited on surrounding cooler interior surfaces of the envelope and other internal components. The freshly deposited getter material binds gases on its surface and/or absorbs residual amounts of such gases to maintain the vacuum state in the tube after it has been exhausted. This process of removing residual gases from an evacuated area by binding and/or absorbing is known as pumping.

Another method of activating the getter by flashing includes applying an electric current directly to the getter material via dedicated terminals. The getter is heated by resistance heating, thereby raising the temperature of the getter material to that necessary to evaporate the getter. This method is often used for in-service activation of gettering material, since the RF method is difficult to apply once the envelope has been installed in an oil-filled housing.

U.S. Pat. No. 5,509,045 to Kautz and U.S. Pat. No. 6,192,106 to Miller, et al., for example, disclose gettering systems for x-ray tubes.

In activating the getter material, the barium or other vapor condenses on adjacent cool surfaces. If the getter material vapor plates out on the glass envelope or x-ray tube electronic components, problems can ensue. The glass envelope is an insulator and the barium molecules are conductors which hold a static charge. These static charges can arc to other metal structures in the x-ray tube or to each other. This arcing can crack the glass, form short circuits to ground, or the like. Gettering material deposited on anything except grounded components can damage the x-ray tube. The gettering material is typically used in the form of a C-shaped wire with a channel with getter material packed in the channel portion of the wire, or in a ceramic package. This wire is firmly mounted within a cup which surrounds the cathode assembly. The cathode assembly surfaces are grounded via electrical feedthroughs, eliminating electrical arcing from the deposited getter material. The gettering material is contained within a cup getter shield and is positioned adjacent an integral part of the cathode assembly. The getter shield part of the cathode assembly holds the vaporized gettering material within the cathode assembly while still providing access for any stray molecules that need to be absorbed.

In evaporative gettering systems, the getter film produced by flashing reacts with all the residual active gases and, by chemisorption, removes them from the gas phase to reduce the gas pressure within the evacuated envelope. However, the sorption capacity of the deposited getter is limited. As sorption capacity is approached, the ability of the getter to absorb additional gas molecules is diminished. The components of the x-ray tube continue to evolve gases during service. As the getter material becomes saturated and less efficient in removing gas molecules, the pressure in the evacuated envelope increases. Over time, the gettering material reaches saturation, i.e., it can no longer absorb stray gases.

When the gas pressure within the evacuated region of the x-ray tube increases, the mean free path between gas molecules is reduced such that a chain reaction is more likely to occur when the gas molecules in the envelope are ionized by the high electric fields generated during normal tube operation. This chain reaction is termed an avalanche and is a form of arcing, which can lead to catastrophic failure of the tube. In x-ray tubes, this tendency to arc often increases as the tube ages.

One way to reduce this potentially damaging arcing is to refresh the gettering material during service. U.S. Pat. No. 6,192,106, for example, discloses a field-flashable gettering system in which an additional gettering coil is activated in the field when the conditions indicate that the main gettering system is reaching the end of its useful life.

For higher power x-ray tubes currently in use, the amount of gettering material surface area available for gas absorption is currently limited by the size of the cathode assembly getter shield cup. Additionally, the rate of pumping is dependent on the amount of available getter material surface. As tubes get larger, the limited amount of getter material available in the getter shield cup leads to long pumping times.

The present invention provides a new and improved x-ray tube using a getter shield and method which overcomes the above-referenced problems and others.

SUMMARY OF THE INVENTION

In accordance with one aspect of the present invention, an x ray tube is provided. The x-ray tube includes an envelope which encloses an evacuated chamber. The envelope includes an electrically conductive portion. A cathode is disposed within the chamber for providing a source of electrons. An anode is disposed within the chamber and positioned to be struck by the electrons and generate x-rays. A gettering material is in electrical contact with the electrically conductive portion for absorbing stray gases within the chamber.

In accordance with another aspect of the present invention, an x ray tube is provided. The x-ray tube includes an envelope which defines an evacuated chamber. A cathode is disposed within the chamber for providing a source of electrons. An anode is disposed within the chamber and positioned to be struck by the electrons and generate x-rays. A piece of gettering material is disposed adjacent an electrically conductive portion of the envelope, which, when activated, deposits a layer of gettering material on the electrically conductive portion.

In accordance with another aspect of the present invention, a method of removing gases from an evacuated chamber of an x-ray tube is provided. The method includes disposing a gettering material adjacent a conductive portion of an envelope which defines the chamber and flashing at least a portion of the gettering material such that a layer of the gettering material is deposited on the conductive portion of the envelope.

One advantage of at least one embodiment of the present invention is that an x-ray tube has an increased useful life.

Another advantage of at least one embodiment of the present invention resides in the ability to refresh an x-ray tube gettering system during service.

Another advantage of at least one embodiment of the present invention is that it enables x-ray tubes of larger evacuated volumes to maintain proportional increases in the gettering system.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
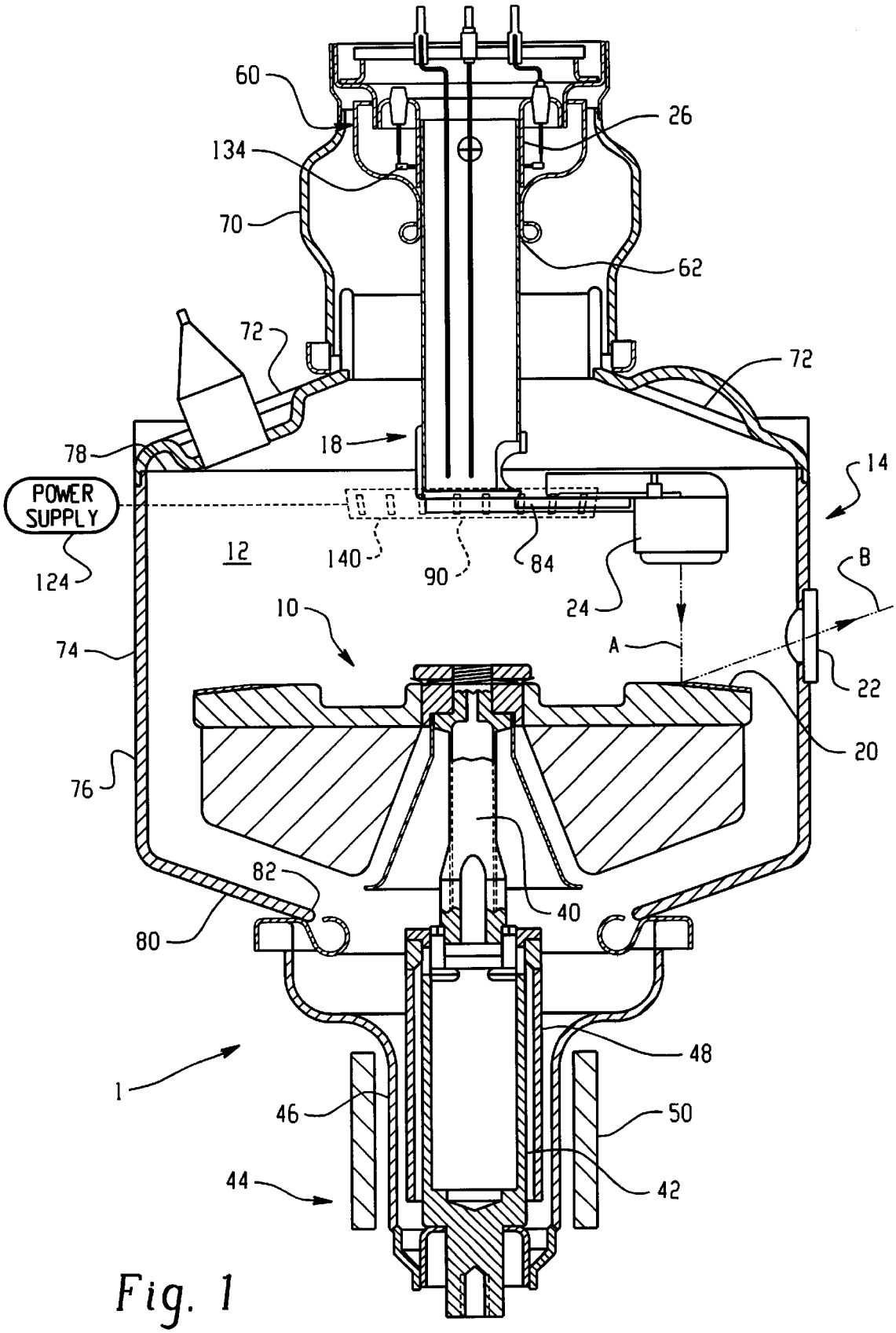
FIG. 1 is a schematic sectional view of a rotating anode x-ray tube according to the present invention, showing a getter shield in phantom.

With reference to FIG. 1, a rotating anode x-ray tube 1 of the type used in medical diagnostic systems for providing a beam of x-ray radiation is shown. The tube includes an anode 10 which is rotatably mounted in an evacuated chamber 12, defined by an envelope or frame 14. A heated element cathode assembly 18 supplies and focuses an electron beam A, which strikes a target area 20 of the anode. A portion of the beam striking the target area is converted to x-rays B, which are emitted from the x-ray tube through a window 22 in the envelope. The cathode assembly includes a cathode cup 24, which is supported in the envelope by a cathode support assembly 26.

As defined herein, the term "envelope" means that portion of the x-ray tube which surrounds the evacuated chamber and spaces it from the exterior environment, such as an oil cooling bath (not shown), or the like. The term envelope is not intended to encompass the anode, cathode, or cathode support assembly, which are within the chamber.

The target 20 of the anode is connected to a shaft 40, which is supported by bearings 42 and driven by an induction motor 44 in a neck portion 46 of the evacuated envelope 14. A rotor 48 is electromagnetically coupled with a stator 50 on the outside of the evacuated envelope neck portion. The anode is rotated at high speed during operation of the tube. It is to be appreciated that the invention is also applicable to stationary anode x-ray tubes, rotating cathode tubes, and other electrode vacuum tubes.

A cathode assembly getter shield 60 is disposed at an opposite end of the x-ray tube from the anode 10. The cathode assembly gettering shield 60 surrounds the support assembly 26 for the cathode assembly 18, including the electronics and electrical feedthroughs used to operate the cathode and provide a high voltage across the cathode and anode. The cathode assembly getter shield 60 is in the shape of a cup, with a central aperture 62 through which the support assembly 26 extends.

The envelope or frame 14 is formed from several components which are welded or otherwise sealed together to provide the vacuum-tight chamber 12. These components include an end cap 70, preferably formed from glass or other suitable electrical insulating material. The insulating cathode end cap 70 surrounds and provides support for the cathode assembly getter shield 60 and cathode assembly 18 and insulates the electronic components of the cathode. The end cap 70 is connected to a frusto-conical top 72, which is preferably formed from an electrically conductive material, such as copper, aluminum, or other electrically conductive structural metal or other material. The top 72 is welded to a body or main frame portion 74, which is also preferably formed from an electrically conductive, structural material, such as copper or aluminum, although a glass or ceramic body is also contemplated. The body (main frame portion) includes a cylindrical midsection 76 which is connected at a first open end 78 with the top 72, and a tapered portion 80, which tapers inward from the midsection (or may be formed from a separate element) toward a second open end 82 of the body. The midsection 76 has the window assembly 22 mounted therein. The neck portion 46, which is preferably formed from glass or other electrically insulative material, is sealed to the body at the second open end 82.

The electrically conductive portion(s) of the envelope thus preferably include all or portions of the top 72 and/or body 74. More preferably, the top 72 and body 74 are both electrically conductive. Optionally, the neck portion 46 is also electrically conductive. It should be appreciated that at least a portion of the envelope 14 (such as end cap 70) is preferably non-conductive to electrically isolate the conductive portions of the envelope from the cathode.

The midsection 76 of the main frame portion is generally the widest part of the envelope and surrounds the anode 10, the cathode cup 24, and an arm 84 of the cathode assembly which extends radially outwardly from the main support 26 of the cathode assembly to the cathode cup 24. As part of the frame is made from metal or other electrically conductive materials, and thus is grounded in use, arcing of getter material deposited on the frame is avoided.

Figure 3:
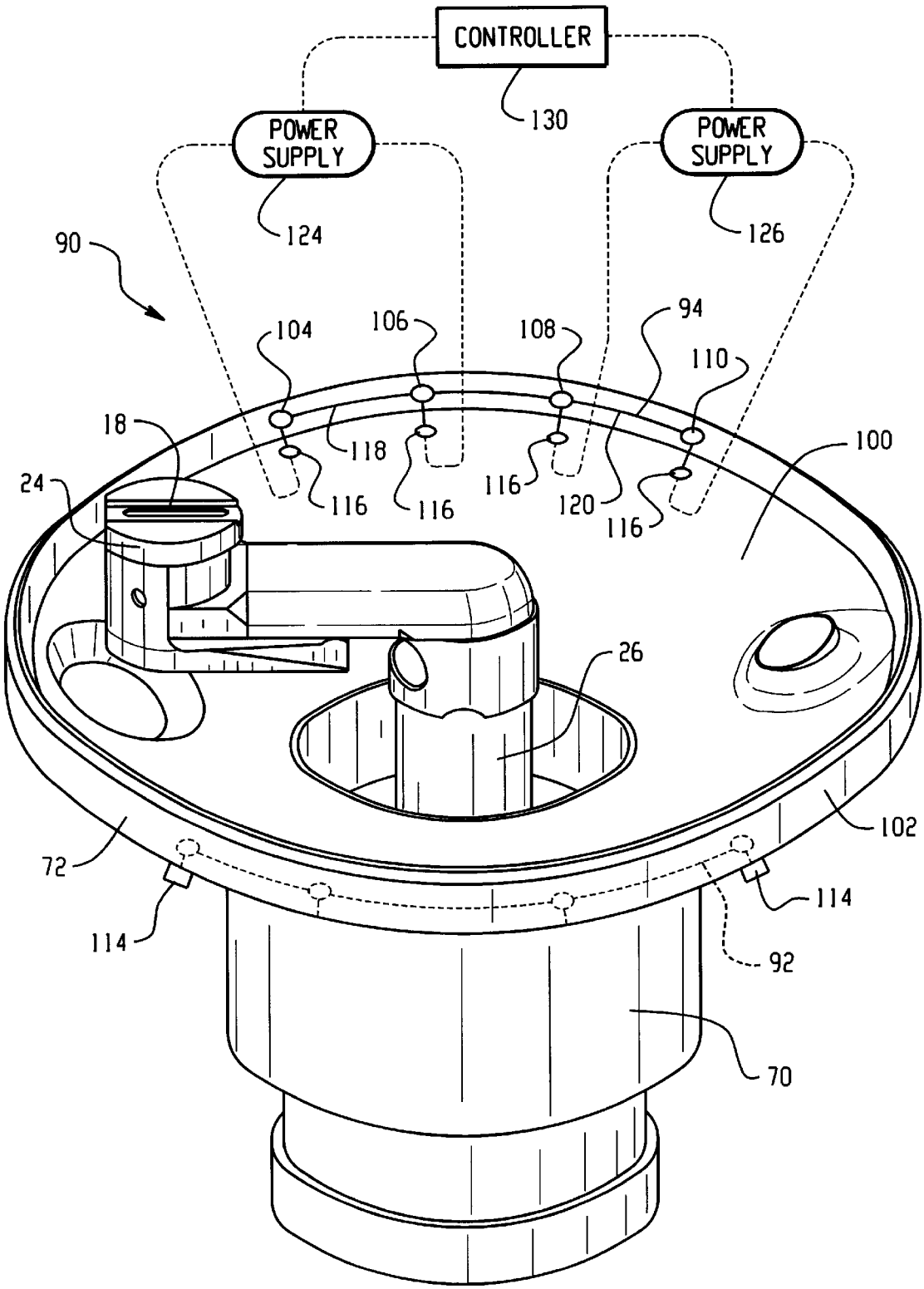
FIG. 3 is a perspective side view of the top of the frame of the x-ray tube of FIG. 1.
Figure 4:
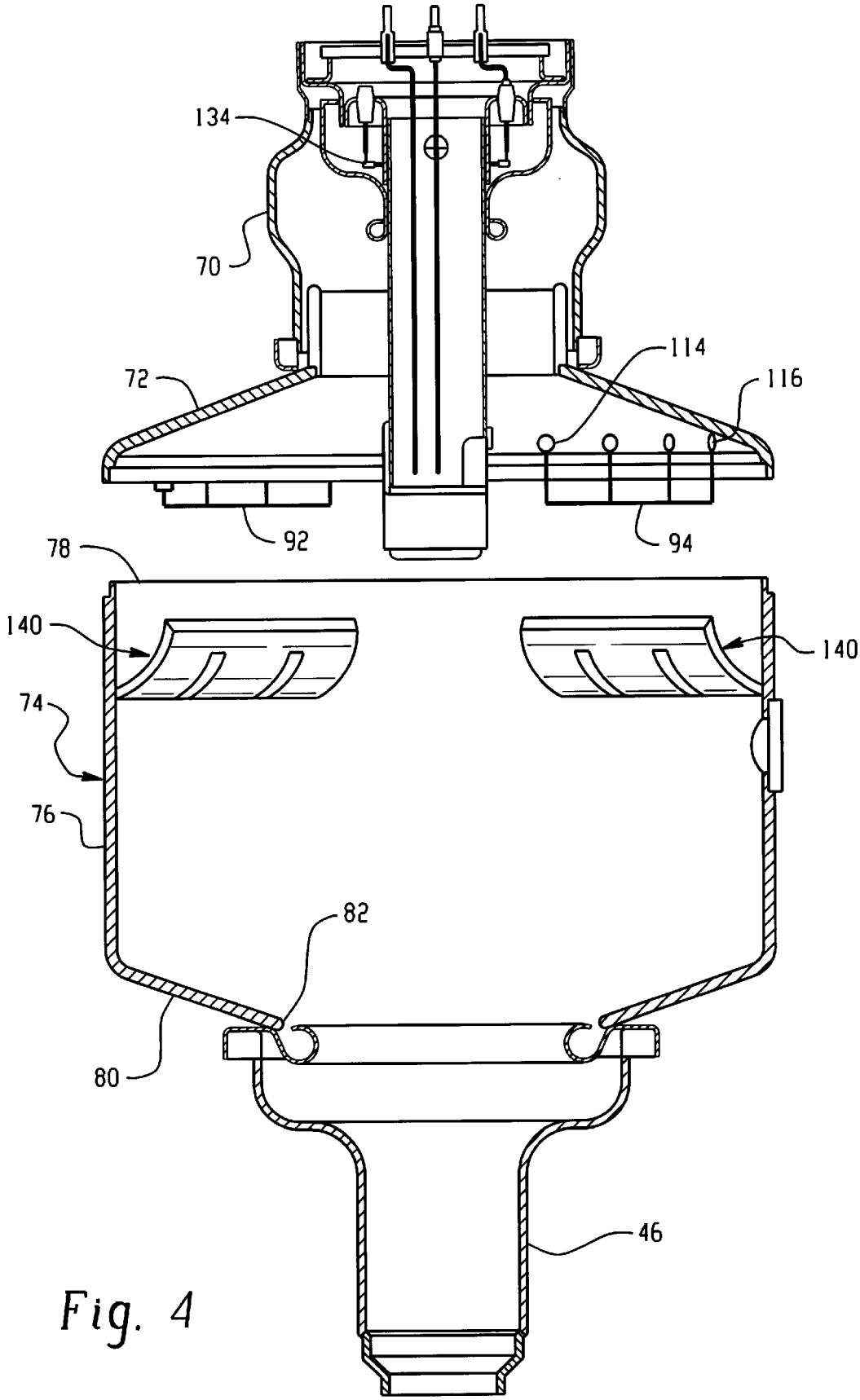
FIG. 4 is an exploded side view of the top and bottom sections of the x-ray tube of FIG. 1.
Figure 5:
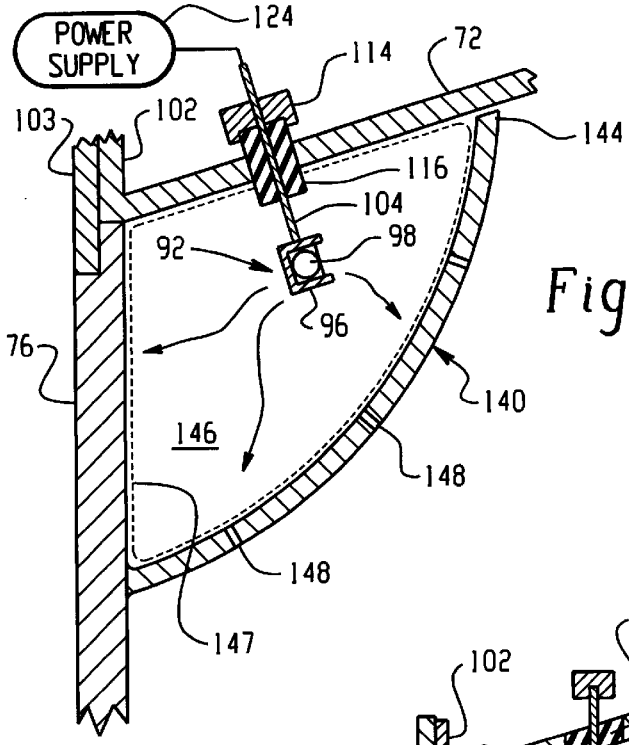
FIG. 5 is an enlarged sectional view of one embodiment of the gettering material and shield of FIG. 1.

With reference also to FIGS. 2–5, a gettering system 90 includes one or more gettering wires 92, 94. As shown in FIG. 5, the getter wires 92, 94 preferably include a conductive wire support 96 having a C-shaped cross section, which is formed from copper, tungsten, or other conductive material. A getter material 98, such as barium, fills the channel formed by the C.

Figure 2:
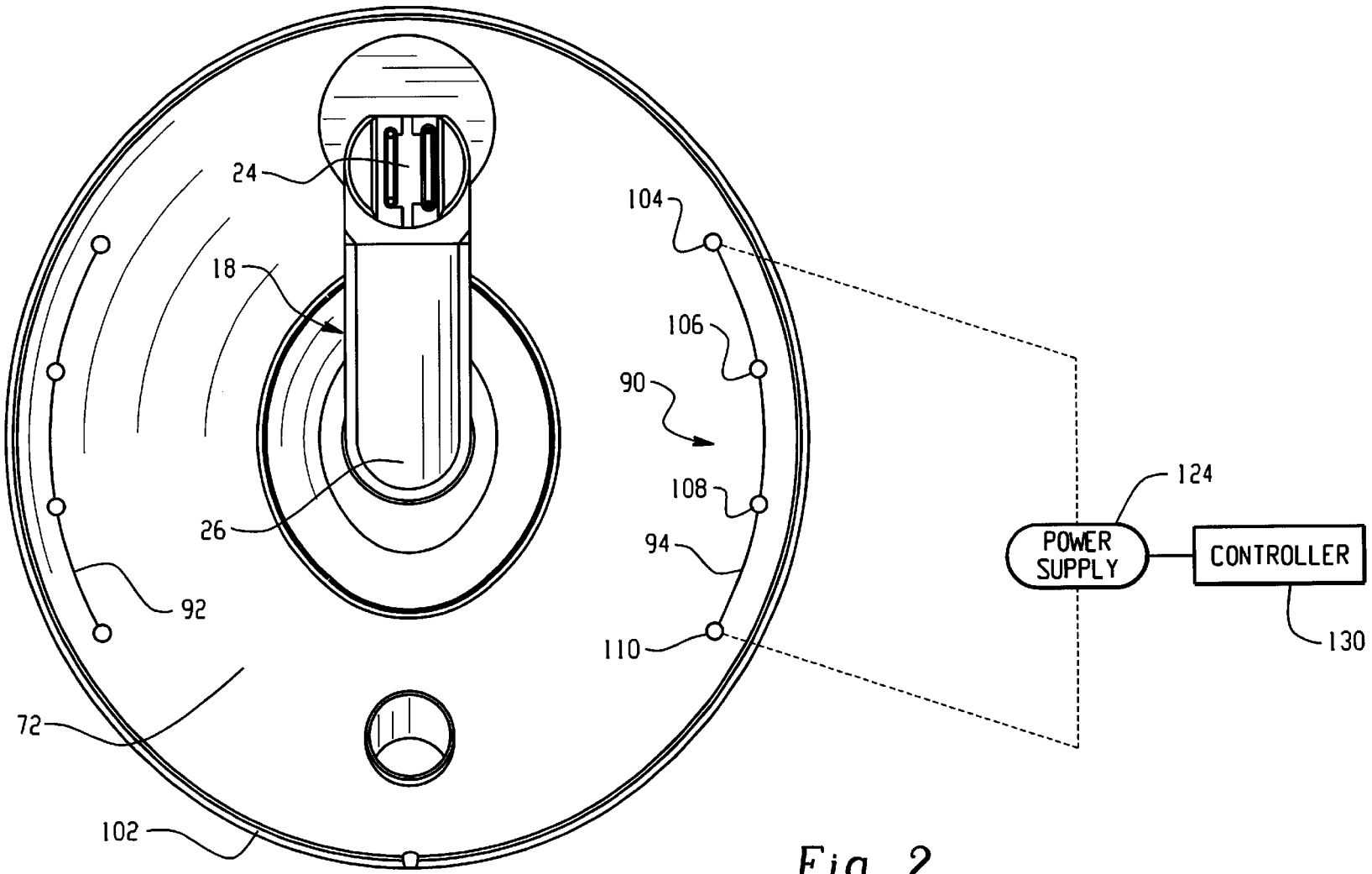
FIG. 2 is a bottom view of the top section of the frame of the x-ray tube of FIG. 1, showing the getter wire and cathode.

The gettering material 98, when activated, serves to absorb stray gases and other molecules within the chamber 12. By absorption, it is meant to include all forms of removal of gases and molecules, including chemical bonding, physical entry of the gases and molecules to the getter material, and the like. Suitable gettering materials include barium, zirconium, and alloys of zirconium with one or more of vanadium, iron, carbon, aluminum, nickel, and the like. FIG. 2 shows two gettering wires 92, 94, one on either side of the cathode assembly. The gettering wire or wires 92, 94 are preferably located adjacent a conductive portion of the envelope, such as adjacent the top 72 of the frame, as shown in FIGS. 2–4.

Figure 6:
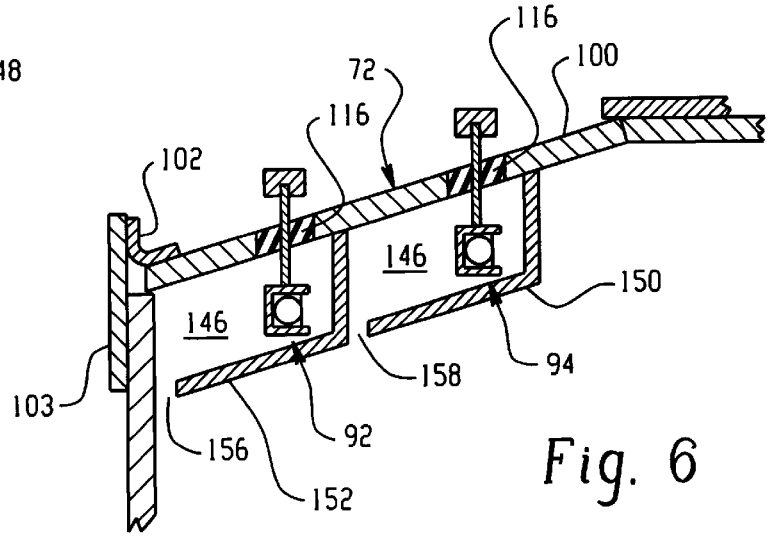
FIG. 6 is an enlarged sectional view of a second embodiment of the gettering material and shield.

In one embodiment, the top 72 of the frame is electrically conductive and has a sloping (or flat) top portion 100 with a lip 102. During assembly of the x-ray tube, the lip is welded or otherwise joined to the open end 78 of the body portion with a bracket 103, as shown in FIG. 6. The wires are preferably supported on supports, such as insulative standoffs 104, 106, 108, 110 (four are shown in FIG. 2), which space the wire 92, 94 from the top 72 of the frame. Two or more of the supports, e.g., supports 104, 110, at ends of the wire optionally provide electrical feedthroughs for heating the wire by applying an electric current to vaporize the getter material via dedicated terminals 114 on the outside of the envelope (see FIG. 3). As best shown in FIG. 5, the conductive supports 104, 110 are separated from the adjacent conductive portions of the frame by insulative passthroughs 116, which provide a vacuum tight seal around the supports.

Alternatively, as shown in FIG. 3, sections 118, 120 of the getter wire 96 are separately connected with terminals so that portions of the wire may be flashed off separately. In either case, a source of electrical potential 124, 126, such as an AC power supply, is connected with the terminals 114 for applying a voltage across the wire or section of the wire to flash the getter. The source is under the control of a controller 130.

It is also contemplated that inductive heating may be used to flash the getter. In this embodiment, a source of an electromagnetic field, such as an RF field, is positioned outside the evacuated envelope, proximate the getter wire, which is in the form of a coil or ring located inside the envelope, such as an unbroken ring which extends around the entire lip 102 of the top 72 of the frame. As with the direct heating method, more than one getter wire may be employed. Wires with different gauges, different resonance frequencies, or the like can provide a mechanism for selective flashing.

In yet another embodiment, a low temperature getter material is used, which vaporizes at a relatively low temperature, e.g., from about 150–500° C., so that flashing is readily achieved by simply heating the entire x-ray tube.

In all embodiments, partial flashing may be employed, either by separately flashing two or more getter wires at different times or by flashing off only a portion of the getter material from a single wire at one time and flashing off another portion at a later time. The separate flashings may be carried out during manufacture of the x-ray tube under the control of the controller. Alternatively or additionally, a second or subsequent flashing is optionally used in the field, to refresh an x-ray tube which has been in service for some time and which has exhausted the useful life of the first material to be flashed.

In yet another embodiment, a combination of electrical and RF heating is employed. For example, electrical heating is used to flash a first getter wire (e.g., getter wire 94 in FIG. 3) or portion of a getter wire (e.g., portion 118 of getter wire 94) during manufacture and RF heating is used to flash off a second getter wire (e.g., getter wire 92 in FIG. 3) or portion of a getter wire (e.g., a second portion 120 of getter wire 94) after some time in the field to refresh the gettering material.

In another embodiment, different locations are used for the getter wires. For example, the gettering wire 92, 94 can be used in conjunction with a traditional cathode-dependent gettering system. As shown in FIG. 4, a first getter wire 92 is located in one of the positions illustrated in FIGS. 2 and 3, while a second getter wire 134, for example, within in the cathode assembly getter shield 60, is axially spaced from the first getter wire, and may be activated at a different time from other getter wire(s).

The getter wire 92, 94 is preferably located in a position away from electronic components and the cathode support assembly 28, which may be damaged by plating out of the flashed getter material. The getter material is also preferably located so that it faces and is directed away from glass and other non-conductive components, and those that would tend to revaporize the getter material under normal operating conditions such as the target 20 of the x-ray tube, and to reduce the chance of arcing on the non-conductive components. As can be seen from FIG. 2, the positioning of the getter wire 92, 94 makes good use of the large internal diameter of the frame by being closely spaced to the widest portion 76 of the frame. As shown in FIG. 2, the two getter wires 92, 94 are located on opposite sides of the top 72 of the frame and are spaced from the cathode cup 24, although other locations are also contemplated. For example, as shown in FIG. 6, two getter wires 92, 94 may be radially spaced from each other, one being closer to the lip 102 of the frame top 72, the other being closer to the cathode assembly 26.

Having the getter material 98, or at least some of the getter material, arranged around the metal portions 72, 74 of the envelope provides a much larger internal diameter for the getter material than is available within the cathode assembly getter shield cup 60. As will be appreciated, the frame provides a much larger area and thus larger amounts of getter material may be used. It will be appreciated that the getter shield cup 60 may be eliminated entirely, or used to accommodate a supplementary getter wire.

When activated, the getter material deposits on the adjacent surface of the metal components 72, 74 of the frame. Once again, there is a much larger surface area available for gettering gases on the frame components 72, 74 than is the case when the gettering material is deposited in the much smaller cathode assembly getter shield cup 60.

A getter wire shield 140 preferably at least partially surrounds the getter wire 92, 94 to keep the flashed getter material 98 in a generally defined area, such as on the metal top 72 or body 74 of the frame. The getter shield is preferably formed from a conductive material, such as copper. As shown in FIGS. 4 and 5, the shield 140 preferably takes the form of a flange which extends adjacent the getter wire and extends in an annulus or arcuate sections around the body 74. The two flanges 140 shown in FIG. 4 are permanently attached to and extend radially inwardly of the cylindrical body portion 76 of the frame and extend circumferentially in the area of the corresponding getter wire 92, 94. When the top 72 and body 74 sections are welded together, a distal end 144 of the flange engages the top 72 of the frame, or lies closely adjacent thereto, to create a cavity 146 in which the respective getter wire 92, 94 is located. As shown in FIG. 6, the conductive walls of the cavity are defined by the shield 140, top 72 and midsection 76 of the frame, although other electrically conductive portions of the frame may define walls of the cavity 146, depending on its exact location. When the getter wire is activated, getter material vaporizes and deposits on the walls of the cavity as a layer 147 of getter material. Little getter material escapes from the cavity. Openings, such as slots 148, in the flanges 140 permit the entry of gases into the cavity, without allowing appreciable amounts of getter material 98 out of the cavity. The slots 148 are also preferably too small to allow broken pieces of getter wire to fall out of the cavity into the rest of the chamber 12.

Figure 7:
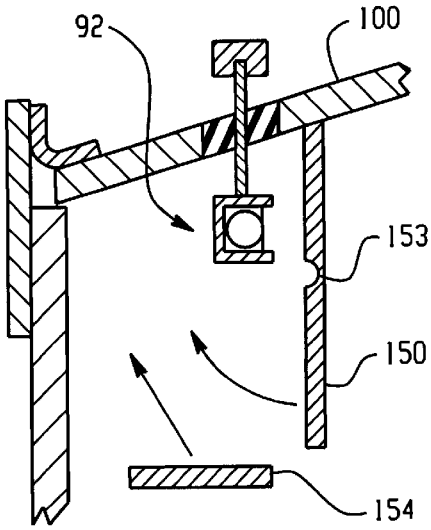
FIG. 7 is a side sectional view showing assembly of the shield of FIG. 6.
Figure 8:
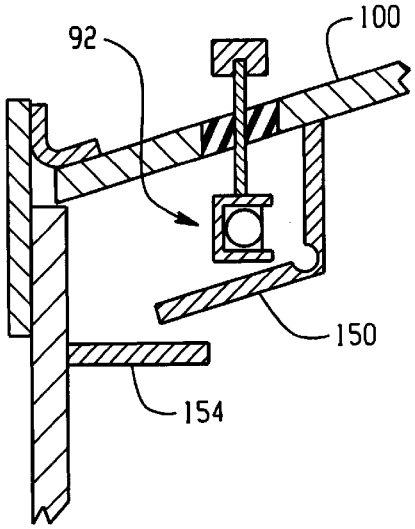
FIG. 8 is a side sectional view following assembly of the shield of FIG. 7.

Other methods of shielding the getter wire are also contemplated. For example, as shown in FIGS. 7 and 8, getter shields 150, 152 with an L-shaped cross section extend from the top 72 of the frame and surrounds the respective getter wire 92, 94. As shown in FIG. 7, a getter shield 150 is optionally formed with a fold line or groove 153 part way along its length, which allows the shield to be bent into the L-shaped configuration shown in FIG. 6. In this embodiment, the shield 150 is brazed, welded, or otherwise attached to the sloping portion 100 of the top 72 of the frame prior to insertion of the gettering material. After installation of the getter wire 92, 94, the copper material for forming the shield is bent into the desired L-shape or other suitable shape to define the cavity 146. An additional piece 154 may be welded or otherwise attached to enclose the cavity as shown in FIG. 8. As with other embodiments, the shield 150 is optionally formed with slots similar to slots 148 for allowing ingress of gases into the cavity. Or, as shown in FIG. 6, the shield or shields is configured to provide a small gap or gaps 156, 158, through which the gases enter the respective cavities 146.

To form the x-ray tube, the components, such as anode, cathode, gettering wire and gettering shield are assembled. The gettering wire 92, 94 is mounted to the supports 104, 106, 108, 110 in the top of the frame and the shield 140 welded or otherwise attached to the body portion 74 or top 72 of the frame. The top 72 of the frame is then welded or otherwise sealed to the frame body 74, for example, by heating to a temperature of about 300° C. Accordingly, the preferred getter material preferably has the ability to withstand heat treatment in air up to this temperature. Evacuation of the x-ray tube is followed by activation of the getter material 98, by applying a current to the getter material to heat it to an appropriate temperature or by applying an RF field which inductively heats the getter wire. Flashing, in this case, is preferably carried out when the tube 1 is cold so that the vaporized getter material rapidly condenses on adjacent cold, electrically conductive surfaces of the frame. (Or, for low temperature getters, the tube is baked and exhausted at an approximate temperature of 500° C. for approximately 55 minutes at about $10^{-5}$ Torr to activate the getter material and remove surface layer of contamination on the getter material as a precursor to a conventional soak process during manufacture.)

As the tube is operated after installation in a diagnostic scanner, residual gases are removed from the vacuum state of the tube by the getter material. This process is called pumping.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An x-ray tube comprising:

an envelope which encloses an evacuated chamber, the envelope including an electrically conductive portion and an electrically insulated end cap;

a cathode assembly disposed within the chamber and supported by the end cap for providing a source of electrons, the end cap electrically isolating the conductive portion of the envelope from the cathode assembly;

an anode disposed within the chamber positioned to be struck by the electrons and generate x-rays;

a gettering system, mounted on the electrically conductive portion of the envelope and electrically isolated therefrom, the gettering system being spaced from the cathode assembly, such that upon activation the gettering system deposits a gettering material in electrical contact with the electrically conductive portion of the envelope for absorbing stray gases within the chamber.

2. The x-ray tube of claim 1, wherein the electrically conductive portion of the envelope includes at least one of a body portion and a top portion of the envelope, the at least one of the top portion and the body portion being substantially electrically isolated from the cathode.

3. The x-ray tube of claim 1, wherein the electrically conductive portion includes a widest region of the envelope.

4. The x-ray tube of claim 1, wherein the conductive portion is substantially formed from a conductive metal.

5. The x-ray tube of claim 1, wherein the conductive metal includes copper.

6. The x-ray tube of claim 1, further including:

a shield for containing the gettering material in a cavity defined in part by the conductive portion of the envelope.

7. The x-ray tube of claim 1, further including:

a shield which surrounds the gettering material while permitting access to the gettering material by stray gases in the chamber.

8. An x-ray tube comprising:

an envelope which encloses an evacuated chamber, the envelope having at least one narrow region and a wide region, the wide region including at least an electrically conductive portion;

a cathode disposed within the narrow region of the envelope for providing a source of electrons and cathode being electrically insulated from the envelope;

an anode disposed within the wide region of the envelope and positioned to be struck by the electrons accelerated from the cathode and generate x-rays;

a strip of gettering material disposed in the widest region electrically insulated from and adjacent the electrically conductive portion such that when the gettering material is flashed, the gettering material forms of a layer on the electrically conductive portion of the widest region of the envelope.

9. An x-ray tube comprising:

an envelope which encloses an evacuated chamber, the envelope including an electrically conductive portion;

a cathode disposed within the chamber for providing a source of electrons;

an anode disposed within the chamber positioned to be struck by the electrons and generate x-rays;

a gettering material in electrical contact with the electrically conductive portion for absorbing stray gases within the chamber;

a shield mounted to the electrically conductive portion of the envelope which surrounds the gettering material while permitting access to the gettering material by stray gases in the chamber, the shield including openings which permit access to the gettering material by stray gases in the chamber.

10. An x-ray tube comprising:

an envelope which defines an evacuated chamber;

a cathode disposed within the chamber for providing a source of electrons;

an anode disposed within the chamber positioned to be struck by the electrons and generate x-rays;

a piece of gettering material, spaced radially outward from the cathode and supported by an adjacent electrically conductive portion of the envelope, which gettering material, when activated, deposits a layer of gettering material on the adjacent electrically conductive portion.

11. The x-ray tube of claim 10, wherein the gettering material is in the form of a wire which is supported on supports which are electrically insulated from the conductive portion.

12. The x-ray tube of claim 11, further including:

insulated electrical feedthroughs which carry electrical current through the envelope to the piece of gettering material for activating the gettering material.

13. The x-ray tube of claim 10, further including:

a second piece of gettering material which is separately activatable to produce a second layer of gettering material.

14. The x-ray tube of claim 10, further including:

a shield, mounted to the envelope, which directs the gettering material toward the electrically conductive portion of the envelope during activation.

15. An x-ray tube comprising:

an envelope which defines an evacuated chamber;

a cathode cup disposed within the chamber for providing a source of electrons;

an anode disposed within the chamber positioned to be struck by the electrons and generate x-rays;

a piece of gettering material disposed adjacent a cylindrical portion of an electrically conductive portion of the envelope which surrounds the anode the gettering material being positioned radially outward of the cathode cup, such that when the gettering material is activated, it deposits a layer of gettering material on the adjacent electrically conductive portion of the envelope.

16. A method of removing gases from an evacuated chamber of an x-ray tube, the method including:

supporting a gettering material on a conductive portion of an envelope which defines the chamber on electrically isolating supports, the conductive portion of the envelope being electrically isolated from a cathode assembly; and flashing at least a portion of the gettering material such that a layer of the gettering material is deposited on an adjacent region of the conductive portion of the envelope.

17. The method of claim 16, wherein the method further includes:

disposing a second gettering material within the envelope; and flashing the second portion of the gettering material such that a second layer of the gettering material is deposited on a conductive portion of the x-ray tube.

18. The method of claim 17, wherein the conductive portion of the x-ray tube is the conductive portion of the envelope.

19. The method of claim 16, further including:

enclosing the gettering material within a cavity, walls of the cavity being defined in part by the conductive portion of the envelope.

20. A method of removing gases from an evacuated chamber of an x-ray tube, the method comprising:

disposing a gettering material radially outward of a cathode assembly which is biased to a negative potential and adjacent a conductive portion of an envelope which defines a chamber; and flashing at least a portion of the gettering material such that a layer of the gettering material is deposited on the conductive portion of the envelope; and grounding the conductive portion of the envelope, such that the flashed gettering material is grounded to prevent accumulation of static charge.

* * * * *